US010874566B2

(12) United States Patent
Frei

(10) Patent No.: US 10,874,566 B2
(45) **Date of Patent: *Dec. 29, 2020**

(54) STAND UP WHEELCHAIR

(71) Applicant: LEVO AG WOHLEN, Wohlen (CH)

(72) Inventor: Thomas Frei, Wohlen (CH)

(73) Assignee: Levo AG Wohlen, Wohlen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/437,812

(22) Filed: Jun. 11, 2019

(65) Prior Publication Data

US 2019/0358103 A1 Nov. 28, 2019

Related U.S. Application Data

(63) Continuation of application No. 15/123,885, filed as application No. PCT/CH2015/000035 on Mar. 4, 2015, now Pat. No. 10,314,751.

(51) Int. Cl.

| | |
|---|---|
| ***A61G 5/10*** | (2006.01) |
| ***A61G 5/14*** | (2006.01) |
| ***A61G 5/12*** | (2006.01) |
| ***A61G 5/02*** | (2006.01) |

(52) U.S. Cl.

CPC ..... *A61G 5/14* (2013.01); *A61G 5/02* (2013.01); *A61G 5/1054* (2016.11); *A61G 5/1067* (2013.01); *A61G 5/128* (2016.11)

(58) Field of Classification Search

CPC ..... A61G 5/1067; A61G 5/122; A61G 5/125; A61G 5/128; A61G 5/14; A61G 5/02; A61G 5/1054

See application file for complete search history.

(56) References Cited

U.S. PATENT DOCUMENTS

| | | | | |
|---|---|---|---|---|
| 4,519,649 A * | 5/1985 | Tanaka | A61G 5/14 297/316 |
| 5,556,121 A * | 9/1996 | Pillot | A61G 5/14 180/907 |
| 5,984,338 A * | 11/1999 | Meyer | A61G 5/14 280/304.1 |
| 6,250,717 B1 * | 6/2001 | Porcheron | A61G 5/12 297/411.3 |

(Continued)

FOREIGN PATENT DOCUMENTS

| | | | |
|---|---|---|---|
| CA | 2464074 A1 * | 5/2003 | A61G 5/1067 |
| CA | 2941579 A1 * | 9/2015 | A61G 5/14 |

(Continued)

OTHER PUBLICATIONS

Machine Translation of EP1488770A1; http://translationportal.epo.org/emtp/translate/?ACTION=description-retrieval&COUNTRY=EP&ENGINE=google&FORMAT=docdb&KIND=A1&LOCALE=en_EP&NUMBER=1488770&OPS=ops.epo.org%2F3.2&SRCLANG=fr&apikey=TSMqTrVAvNtryGI8QlfbozJ8DnAGlqJ&TRGLANG=en; Jul. 16, 2018 (Year: 2018).‡

*Primary Examiner* — Ryan D Kwiecinski
(74) *Attorney, Agent, or Firm* — Davis. Brown, Koehn, Shors & Roberts, P.C.; Sean D. Solberg

(57) ABSTRACT

The invention relates to a stand-up wheelchair, comprising a chassis and a stand-up frame articulated to the chassis. The stand-up frame comprises a first and a second parallelogram lever whose front ends are articulated to the chassis and can be pivoted around a first and a second joint point, and upon whose rear ends the backrest is hinged at a third and fourth joint point.

19 Claims, 11 Drawing Sheets

(56) References Cited

U.S. PATENT DOCUMENTS

| | | | | |
|---|---|---|---|---|
| 7,845,665 | B2 * | 12/2010 | Borisoff | A61G 5/14 280/250.1 |
| 8,870,216 | B2 * | 10/2014 | Maurer | A61G 5/08 280/657 |
| 9,867,747 | B2 * | 1/2018 | Maurer | A61G 5/14 |
| 9,901,498 | B2 * | 2/2018 | Eddy | A61G 5/1083 |
| 2002/0153697 | A1 * | 10/2002 | Amirola | A61G 5/128 280/304.1 |
| 2004/0212177 | A1 * | 10/2004 | Kuiken | A61G 5/1054 280/647 |
| 2005/0104332 | A1 * | 5/2005 | Hsu | A61G 5/14 280/650 |
| 2007/0169270 | A1 * | 7/2007 | Chai | A61G 5/1059 5/620 |
| 2007/0296177 | A1 * | 12/2007 | Porcheron | A61G 5/1054 280/250.1 |
| 2013/0113178 | A1 * | 5/2013 | Goldish | A61G 5/14 280/250 |
| 2013/0278032 | A1 * | 10/2013 | Hunziker | A61G 5/1067 297/340 |
| 2016/0220432 | A1 * | 8/2016 | Ooyama | A61G 5/02 |
| 2017/0119603 | A1 * | 5/2017 | Eddy | A61G 5/0825 |

FOREIGN PATENT DOCUMENTS

| | | | | |
|---|---|---|---|---|
| DE | 19927244 | A1 * | 12/1999 | A61G 5/12 |
| DE | 102005038030 | A1 * | 2/2007 | A61G 5/14 |
| DE | 202007018454 | U1 | 7/2008 | |
| DE | 202007018454 | U1 ‡ | 7/2008 | A61G 5/1067 |
| DE | 202013002877 | U1 * | 5/2013 | A61G 5/1067 |
| EP | 0815822 | B1 | 1/1999 | |
| EP | 0815822 | B1 ‡ | 1/1999 | A61G 5/14 |
| EP | 1488770 | A1 * | 12/2004 | A61G 5/1054 |
| EP | 2374438 | A1 * | 10/2011 | A61G 5/14 |
| EP | 2389914 | A1 | 11/2011 | |
| EP | 2389914 | A1 ‡ | 11/2011 | A61G 5/1067 |
| FR | 2717377 | A1 * | 9/1995 | A61G 5/1054 |
| FR | 2870451 | A1 * | 11/2005 | A61G 5/128 |
| WO | WO-2013041972 | A2 * | 3/2013 | A61G 5/14 |

* cited by examiner
‡ imported from a related application

STAND UP WHEELCHAIR

CROSS-REFERENCE TO RELATED APPLICATION(S)

This application claims priority as a continuation of 35 U.S.C. § 371 application Ser. No. 15/123,885, filed Dec. 7, 2016 and entitled "Stand-Up Wheelchair," which claims the benefit to Switzerland Application 313/14, filed Mar. 4, 2014, both of which are hereby incorporated herein by reference in their entireties.

BACKGROUND OF THE INVENTION

European patent EP 0 815 822 shows a stand-up wheelchair with a chassis and a stand-up frame that comprises a seat and a backrest. The stand-up frame comprises two parallelogram levers whose front ends are articulated to the chassis and are pivotable around fixed pivot points. The backrest is articulated to the rear ends of the parallelogram levers. Attaching the stand-up frame by way of two parallelogram levers has the advantage that the tilt angle of the backrest will not change when erecting the stand-up frame, thus the tilt angle that the backrest assumes relative to the horizontal in the sitting position is also present in the stand-up position.

A disadvantage of the stand-up wheelchair described is that the tilt of the backrest cannot be adjusted. However, backrest adjustability is desirable because, depending on the activity, wheelchair users would want to adjust the tilt of the backrest. When using the wheelchair for sporting activities (active riding position), for example, the backrest is tilted forward slightly so that it assumes an acute angle with the horizontal. But during other activities, the wheelchair user would want to sit in the wheelchair in a relaxed manner, and would tilt back (obtuse angle) the backrest accordingly.

For a stand-up wheelchair, it is important that when in the stand-up position, the sitting surface and the backrest surface are arranged essentially parallel to each other. But if the backrest and the sitting surface form an angle larger or smaller than 90 degrees in the sitting position, then the parallelism required disappears. The disadvantage for wheelchair users is that they cannot support their entire body with the stand-up frame in the stand-up position.

The stand-up wheelchair according to EP 0 815 822 has a frame made from tubes upon which the front and rear wheels are arranged. The shaft of a leg support is guided into the frame of the chassis in a translational manner, giving the footrest stable guidance. The stand-up frame is connected to the shaft of the leg support in such a way that when erecting the stand-up frame, the footrest moves down. The disadvantage of this design is that the footrest is arranged so far in front of the sitting surface, that the wheelchair user is prevented from assuming a dynamic sitting position. Wheelchair users who play sport in particular want to assume an active riding position to increase the manoeuvrability of the wheelchair. This riding position is characterised in that the backrest assumes an acute angle with the sitting surface, and the feet are placed as closely as possible to the body.

DE 20 2007 018 454 U1 shows a stand-up wheelchair with a hinged parallelogram made up of two longer and two shorter levers. The longer levers are adjustable in length. The shorter and the longer levers are connected by joints with hinges that allow the levers to move only rotationally relative to each other. The rotational axis of the seat takes a different position on the frame as the rotational axis of the hinged parallelogram. This means the back adjustment has its own hinged parallelogram and the sitting surface moves independently of this. When erecting the wheelchair, the distance between the backrest and the sitting surface of the seat is reduced. It prevents a shearing motion between the back cushion and the back of the wheelchair user. However, the mechanics of this stand-up wheelchair are very complicated. The pivot points of the hinged parallelogram, the seat and the backrest are not level when in the stand-up position. As a result, the wheelchair user cannot lean their whole body on the seat and back cushion.

The stand-up wheelchair according to EP 2 389 914 A1 is constructed using a complicated lever system. One of the levers is a length-adjustable gas spring, which enables the erection of the wheelchair. The sitting surface and the gas spring have their front ends hinged to the wheelchair's holding frame and their rear ends hinged to a plate. The rear end of the sitting surface is L-shaped, thus when in the stand-up position, the rear end of the sitting surface in the area of the plate shifts backwards in the form of a step. As a result, the sitting surface and the backrest do not lie level when in the stand-up position. The plate forms an unpleasant ledge that prevents the wheelchair user from leaning against it.

An object of the present invention is therefore to provide a stand-up wheelchair that permits taking an active riding position. One object in particular is to provide a stand-up wheelchair whose backrest—despite different angular positions to the sitting surface in the sitting position—is essentially on the same level as the sitting surface in the stand-up position. The wheelchair should also allow as many settings as possible, so that the same chair can be customised to different body sizes.

DETAILED DESCRIPTION

Figure 1:
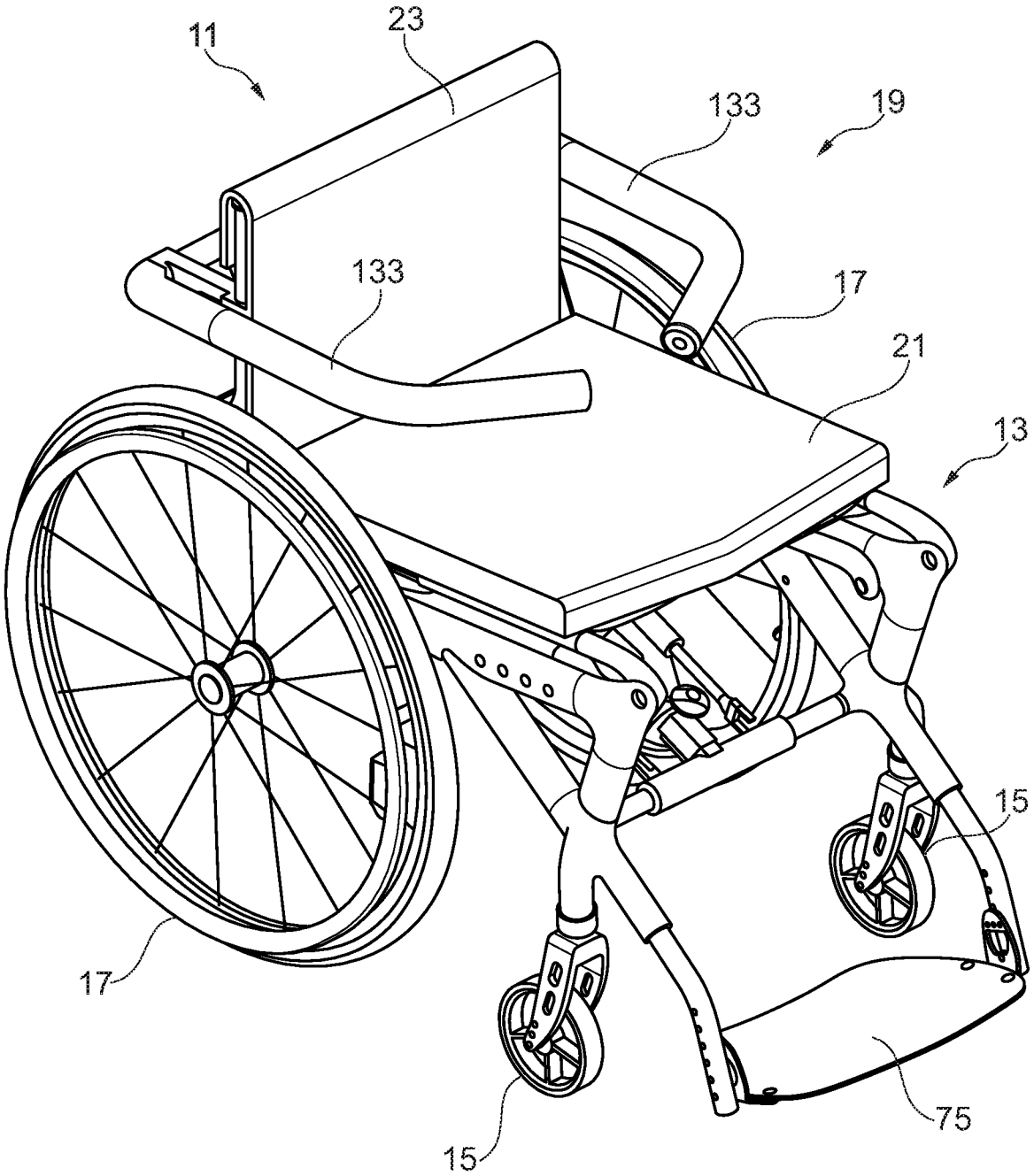
FIG. 1 is a perspective view of a stand-up wheelchair according to the invention consisting of a chassis and a stand-up frame.
Figure 2:
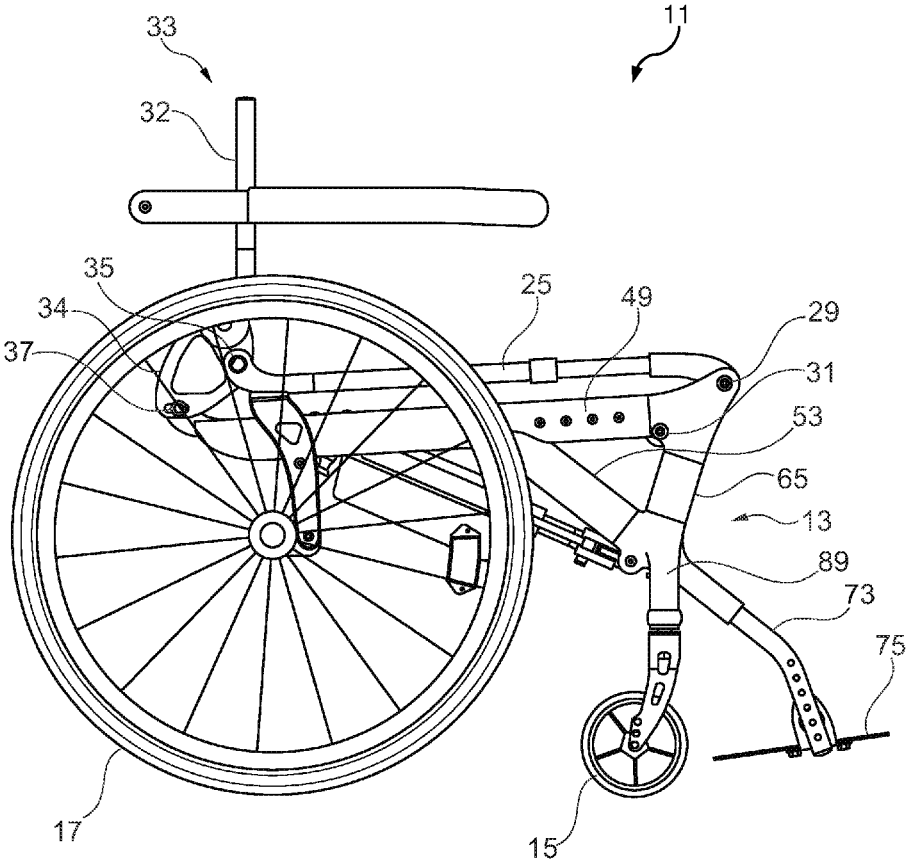
FIG. 2 is a side view of the stand-up wheelchair from FIG. 1.
Figure 3:
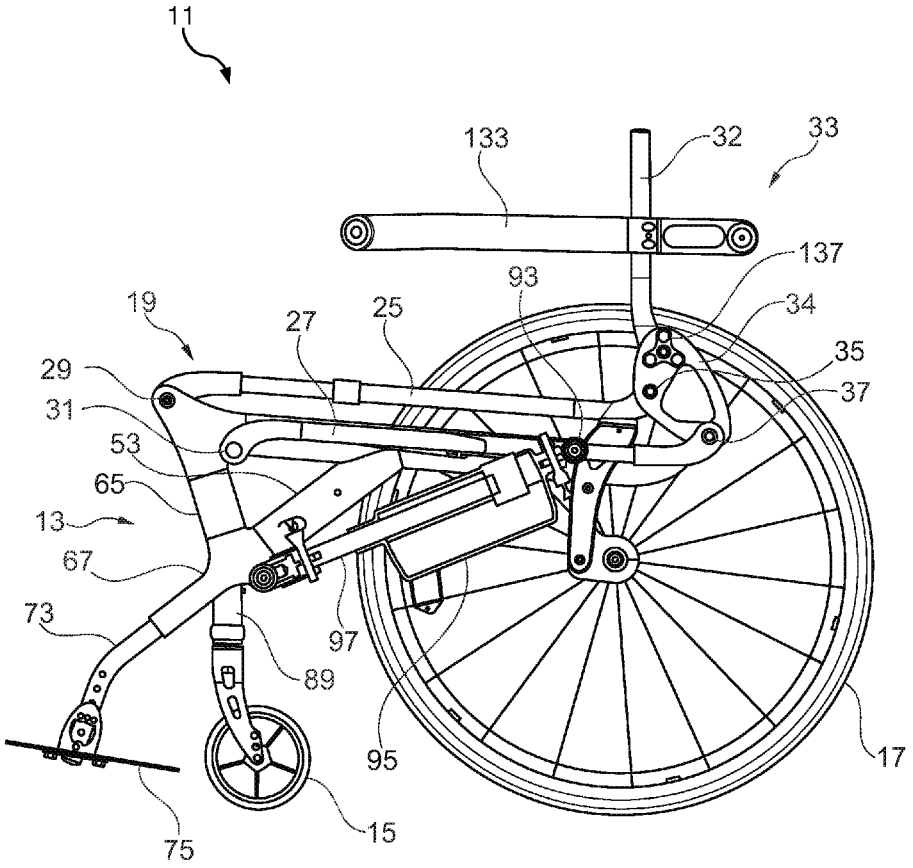
FIG. 3 is a sectional view through the middle of the stand-up wheelchair from FIG. 1 in the sitting position.

The device according to the invention will realize the aforementioned objects through the features of the various claims. Further advantageous developments are also defined in the claims.

The invention relates to a stand-up wheelchair with a chassis and a stand-up frame that is hinged to the chassis. The essential components of the stand-up frame are a first and a second parallelogram lever, hereinafter referred to as sitting rod and adjusting rod. Their front ends are hinged to the chassis and are pivotable around a first and a second joint point. The backrest is hinged to a third and a fourth joint point at the rear ends of the sitting rod and the adjusting rod.

In the device according to the invention, one of the joint points can be adjusted relative to the other joint points. It is particularly preferred if one of the joint points features an adjusting mechanism by means of which the position of the said joint point can be adjusted and secured relative to the other joint points. This has the advantage that the backrest tilt can be adjusted by a moving a joint point. Moving a joint point results in a distorted parallelogram, which is basically a quadrinomial mechanical linkage. However, this may be designed such that the backrest in the stand-up position is aligned essentially parallel to the sitting surface.

As for the parallelism of the backrest and seat in the stand-up position, in the context of the present application it is assumed that the backrest is parallel to the backrest support, its lateral pillars in particular, and the seat is parallel to the sitting rod.

Advantageously, the sitting rod and the adjusting rod are different lengths. Geometry optimisation can be achieved by adjusting the relative lengths of the parallelogram levers. In particular, the parallelism of the backrest and sitting surface in the stand-up position can be optimised independently of the tilt of the backrest in the sitting position.

In an advantageous design, one of the rods, preferably the adjusting rod, is shorter than the sitting rod by a certain amount, preferably between 1 and 30 mm and more preferably between 15 and 25 mm. It has been shown that relative differences in length between 1 and 6%, and preferably 2 and 4%, are sufficient to achieve the desired functionality of the backrest tilt in the sitting and stand-up position, i.e. that the backrest tilt—regardless of its inclination in the sitting position—does not to have to be adjusted during the transition from the sitting position to the stand-up position. The maximum attainable tilt adjustment of ±12 degrees and preferably ±8 degrees from moving the joint point is advantageous. This allows the backrest angle to be adjusted between 78 degrees and 102 degrees, 82 and 98 degrees respectively.

Moving the joint point can be achieved in various ways. One option is to make the adjusting rod and/or the sitting rod adjustable in length. This can be achieved, for example, with a threaded sleeve that has two opposing threads, similar to a wire tightener.

Another option is to equip one of the joint points with an adjusting mechanism, by means of which the position of the said joint point relative to the other joint points can be adjusted in steps. The adjusting mechanism can be implemented by means of an elongated hole and a locking element, for example. The locking element can, for example, be a screw or a clamp screw that can be tightened in any position along the elongated hole.

The adjusting mechanism could therefore be made to be infinitely adjustable. Other types of construction are also conceivable, such as described below.

It has proven advantageous if the elongated hole is provided at a connecting piece that connects the third and fourth joint points. The connecting piece, which acts as one of the levers of the lever parallelogram, may be formed such that the sitting rod, the adjusting rod and the backrest pillar are hinged to it, and the sitting rod and the backrest pillar are level in the stand-up position.

In a further, particularly preferred design, the pivoting mechanism is formed by a base plate and a swivel arm with a first and second end, wherein the swivel arm is hinged to the base plate with its first end pivotable around a fifth joint point. This has the advantage that the backrest tilt is infinitely adjustable and can be quickly adjusted between different positions.

It is advantageous if the sitting rod is connected to the third joint point and the backrest is hinged to the base plate and the adjusting rod is hinged to the second end of the swivel arm via the fourth joint point. This makes the swivel arm easily pivotable towards the base plate, allowing the backrest tilt to be precisely adjusted.

Preferably, the end positions of the swivel arm relative to the base plate are predetermined by a cam. The cam can be realised by a rotary disc that rotates in the base plate, and a bolt that is eccentrically fixed on the rotary disc, for example. The bolt is rotatably received in a feedthrough of the swivel arm. The cam allows the backrest tilt to be very accurate and almost infinitely adjustable. Furthermore, the cam is durable and will not wear down.

Preferably, the position of the fourth joint point can be adjusted by means of the adjusting mechanism, because adjustability of one of the rear joint points is particularly advantageous for operation. Expediently, the first two (front) joint points are fixed points.

Advantageously, the joint points of the sitting rod and the adjusting rod are arranged on the chassis offset from each other by a certain distance in the longitudinal direction of the parallelogram lever, that is to say they are offset from one another but not vertically superimposed.

In a preferred design of the stand-up wheelchair according to the invention, the chassis comprises two side panels that are connected by a strut. This results in a stable construction.

Another aspect of the invention relates to a stand-up wheelchair with a chassis and stand-up frame with a seat and a backrest. The stand-up frame is hinged to the chassis in a pivotable manner. The wheelchair also has a leg support that is lowered to the ground in the transition from the sitting position to the stand-up position. The chassis comprises two side panels that are connected by a strut.

The device according to the invention comprises a single side panel that has a supporting beam with an arm protruding at an angle from the middle third of the supporting beam on or in which a leg support is movably arranged. The mobility of the leg support has the advantage that, during erection of the wheelchair, it can be automatically further extended in order to be lowered to the ground. When returning to the sitting position, it can be returned to a position that is comfortable for the wheelchair user.

Advantageously, the arm is arranged on the supporting beam at a distance from the front end. This has the advantage that the leg support can be arranged close to the chair, allowing the wheelchair user to have their legs in an ergonomic position.

Expediently, the leg support is connected to the stand-up frame in such a way that when erecting the stand-up frame, the leg support is moved forwards and downwards. This has the advantage that it realises forced movement of the leg support in a simple way. The connecting link can be a lever or a gear rack. This allows the leg support to support itself on the ground when in the stand-up position.

The leg support can have a tube on each opposing side, which is axially movably guided into a respective channel of the arm. Such a guiding device is robust and durable in any situation.

Expediently, there is a downwardly projecting connection piece on the arm for attaching the front wheels. The connecting piece can be one piece with the arm or laterally screwed to it. The front wheels being arranged close to the rear wheels results in high manoeuvrability of the wheelchair.

Advantageously, the arm is arranged on the supporting beam at a distance from the front end. This has the advantage that the leg support can be arranged close to the chair, allowing the wheelchair user to take a dynamic sitting position. It has been shown that an angle between 30 and 60 degrees and preferably between 35 and 50 degrees between the arm and the supporting beam is particularly suitable.

A stand-up wheelchair 11 according to the invention is shown in FIGS. 1 to 10. The stand-up wheelchair 11 has a chassis 13 with front wheels 15 and rear wheels 17, and a stand-up frame 19, on which a sitting surface 21 and a backrest 23 is arranged. The stand-up frame 19 essentially consists of two levers, namely a sitting rod 25 and an adjusting rod 27 whose front ends are hinged to the chassis 13 at a first joint point 29 and a second joint point 31. A backrest support 33 is hinged to the rear ends of the sitting rod 25 and the adjusting rod 27. The backrest support 33 consists of a pillar 32 and a connecting piece 34, wherein the sitting rod 25 and the adjusting rod 27 are connected at a third joint point 35 and a fourth joint point 37. The backrest support 33 supports the seat back 23, whereas the backrest support 33 and backrest 23 in principle can also be designed as one piece.

Figure 5:
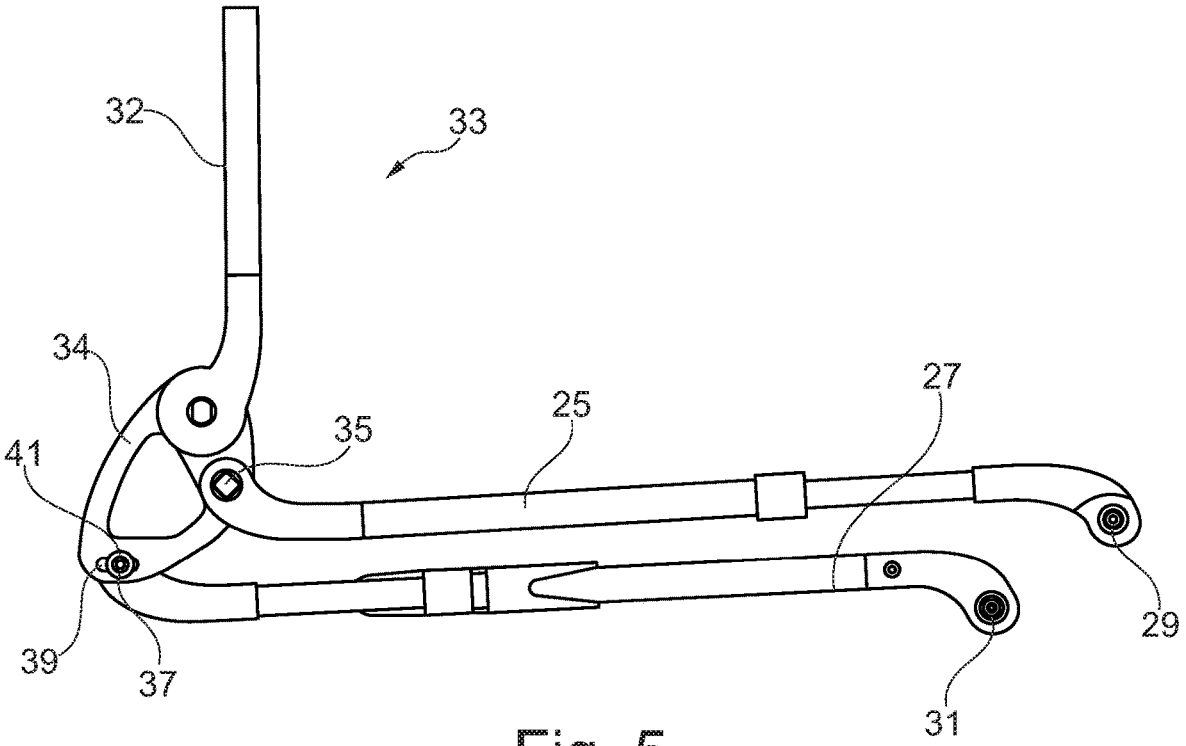
FIG. 5 is a side view of the parallelogram levers and the backrest support of the stand-up frame, wherein the backrest support is tilted forward with an adjusting mechanism in its first design.
Figure 6:
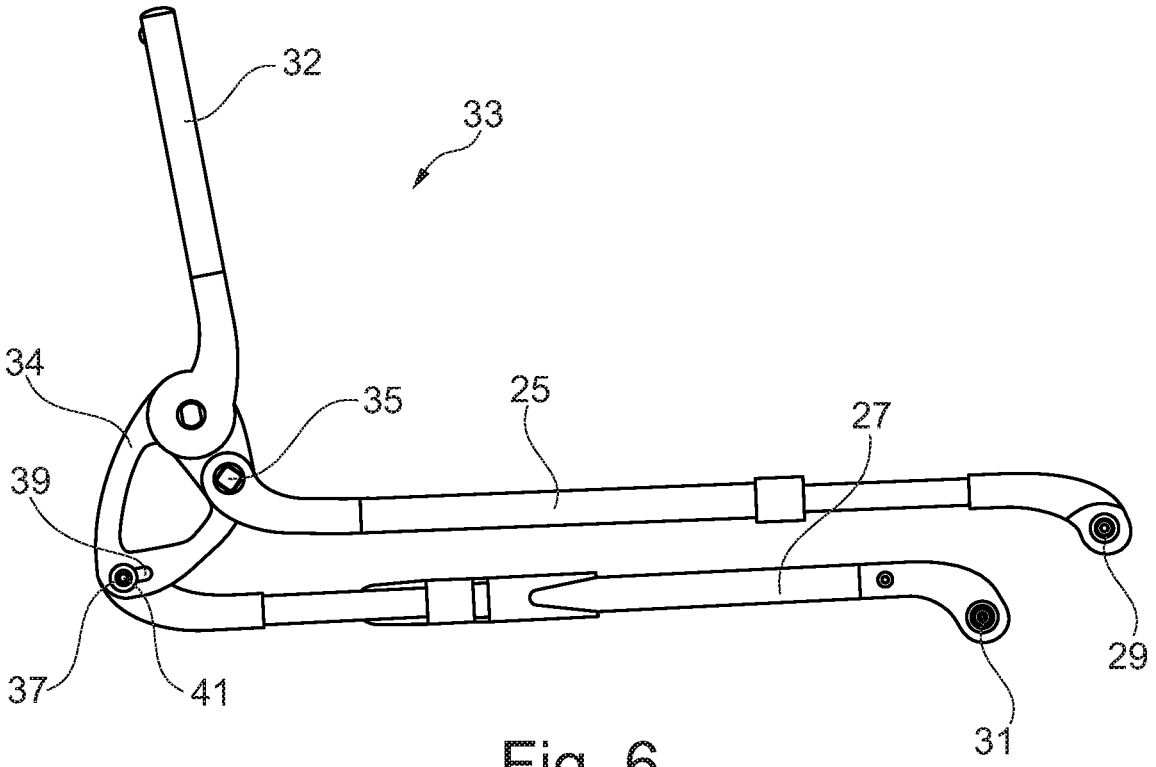
FIG. 6 is a side view of the parallelogram levers and the backrest support of the stand-up frame, wherein the backrest support is tilted backwards.
Figure 7:
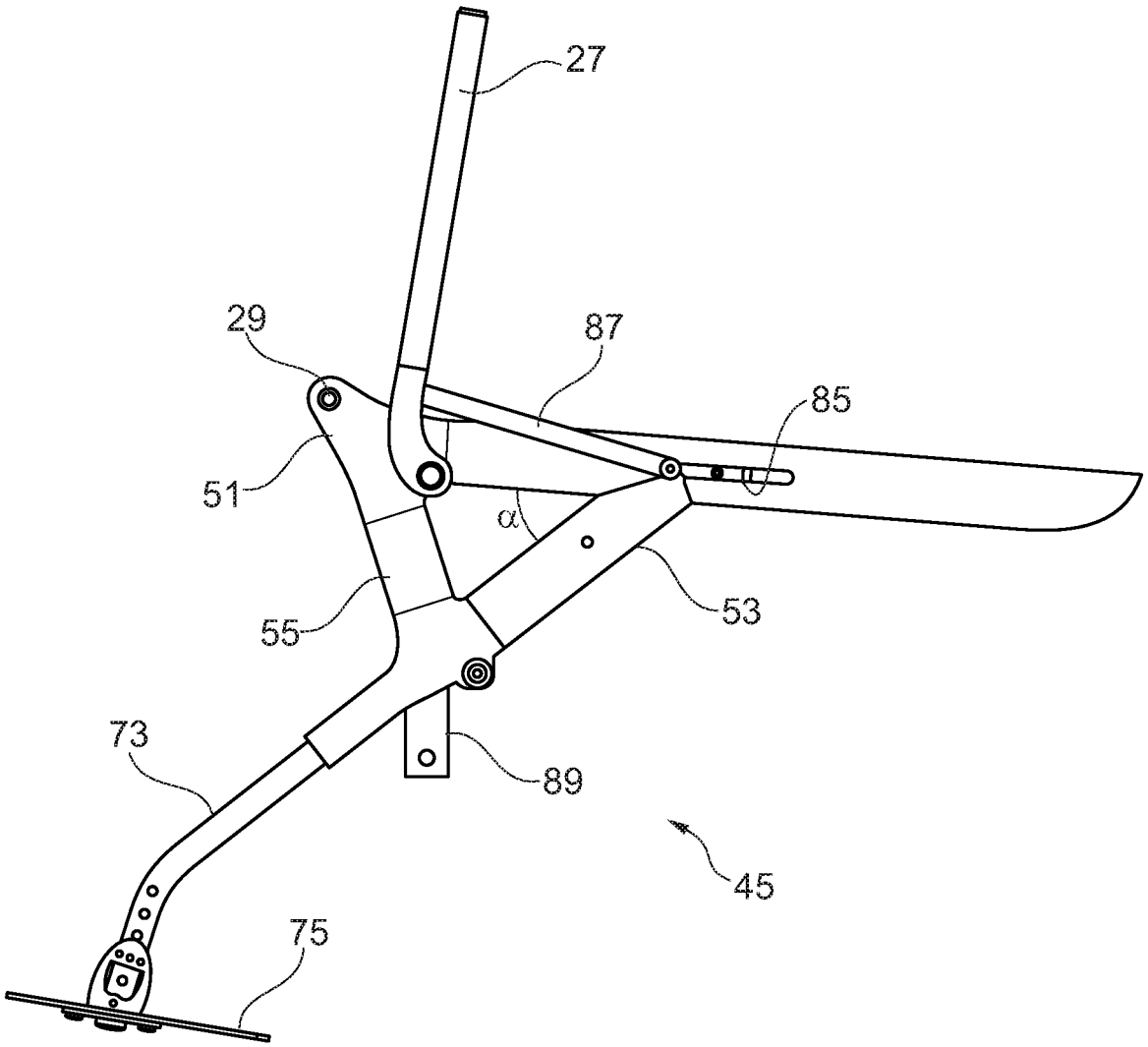
FIG. 7 is a side view of a side panel of the chassis with the second parallelogram lever in the stand-up position and extended leg support.

The special feature of the stand-up wheelchair according to the invention is that the position of a joint point can be shifted relative to the other joint points, making the inclination of the backrest variable to the seat surface. For this purpose, one of the joint points is designed as positionally variable. An adjustment mechanism between the adjusting rod 27 and the backrest support 33 is provided (FIGS. 5 and 6). This adjustment mechanism consists of an elongated hole 39 provided in the connecting piece 34, in which a locking element 41 can take a plurality of lock-in positions (not shown in the figures). A skilled worker would be aware of different solutions to realise the adjustability. Infinite adjustability, for example, is also conceivable. If the locking pin 41 is located right of the middle of the elongated hole 39, then the angle between the sitting rod 25 and the backrest support is <90 degrees (acute angle). If the locking pin 41 is located left of the middle of the elongated hole, then the angle between the sitting rod 25 and the backrest support is >90 degrees (obtuse angle). However, in general you can set the geometry of the configuration in such a way that the middle of the elongated hole does not define the 90° angle between the backrest support and the sitting rod 25.

Figure 4:
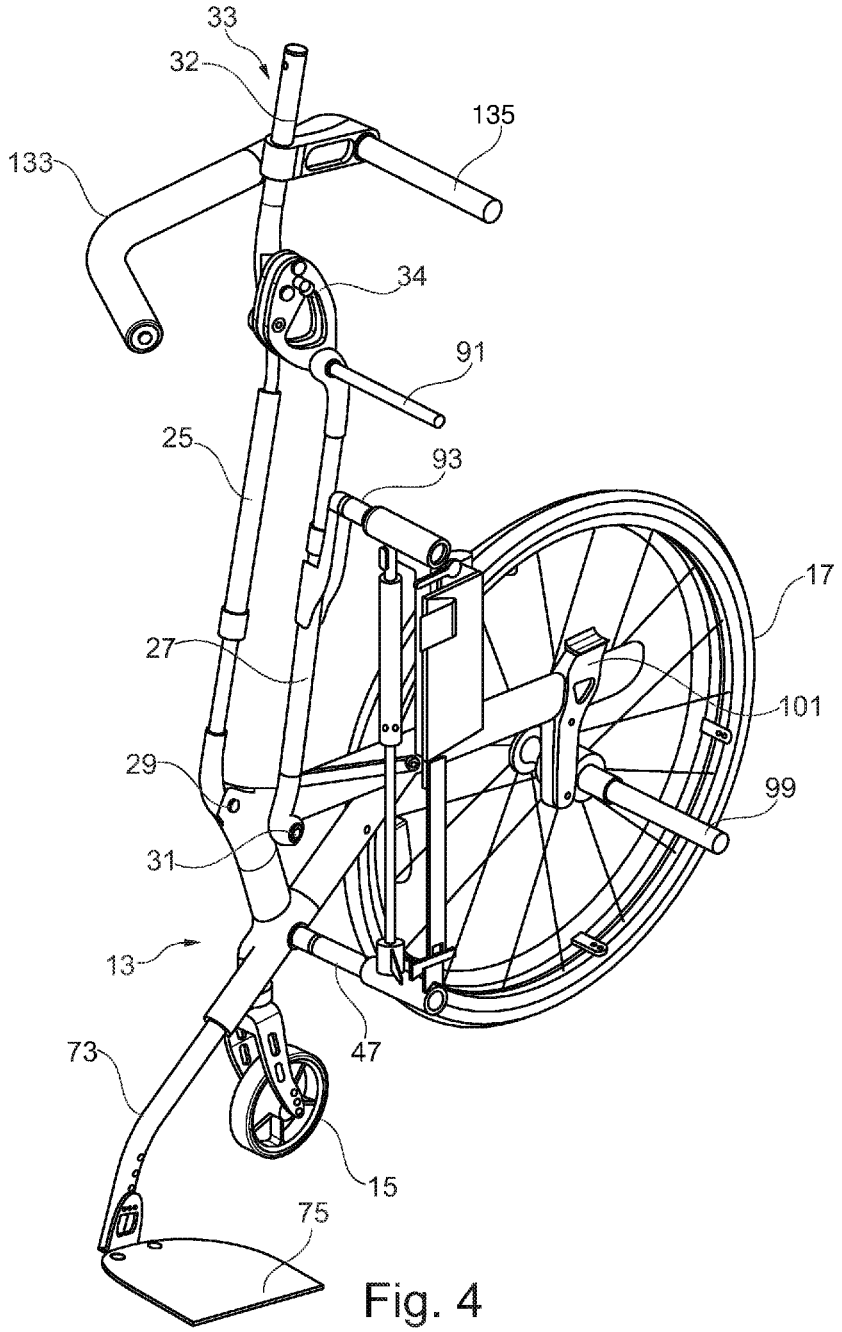
FIG. 4 is a sectional view through the middle of the stand-up wheelchair from FIG. 1 in the stand-up position.

The chassis 13 of the stand-up frame 11 comprises two side panels 45 that are connected to each other by a strut 47 (FIG. 4). A single side panel 45 includes a long supporting beam 49, from which an arm 53 protrudes at an acute angle at a distance from the front end 51. Angle $\alpha$ is between 30 and 70 degrees and preferably between 35 and 55 degrees. The front end 51 of the supporting beam 49 and the arm 53 are connected to each other by means of a connecting bridge 55 to ensure the necessary stability of the side panel 45.

Figure 8:
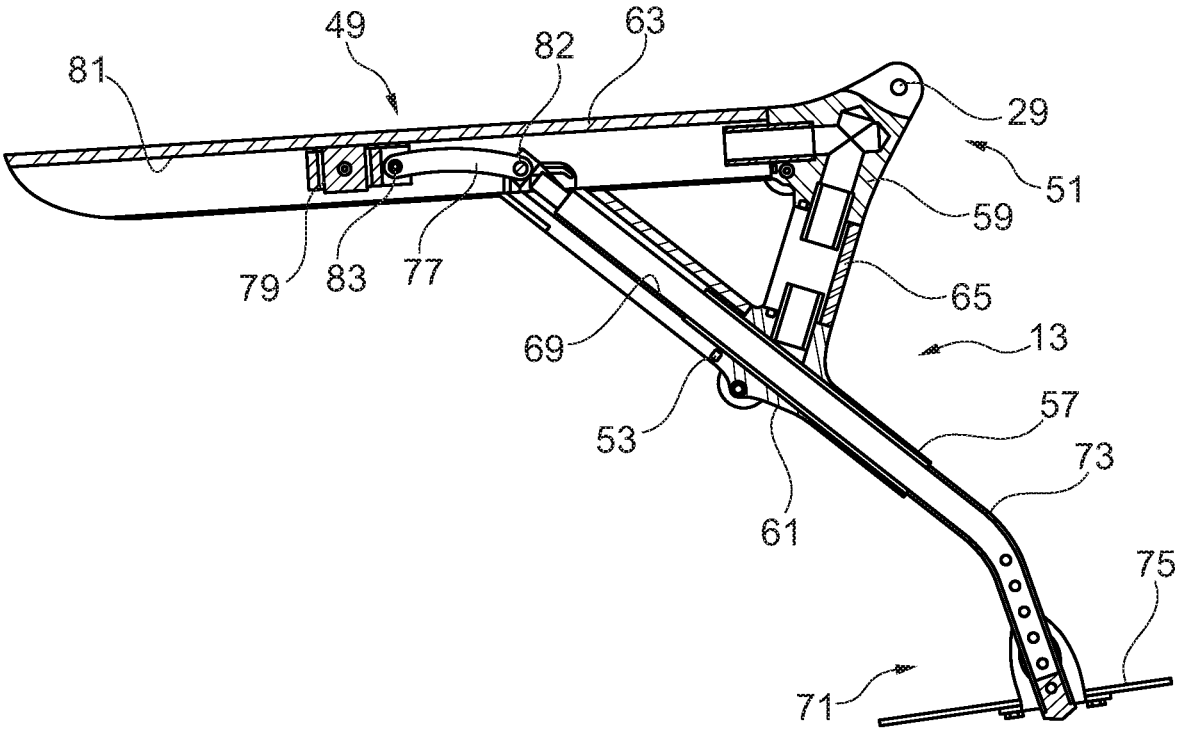
FIG. 8 is a longitudinal section through the side panel of the chassis with retracted leg support.
Figure 9:
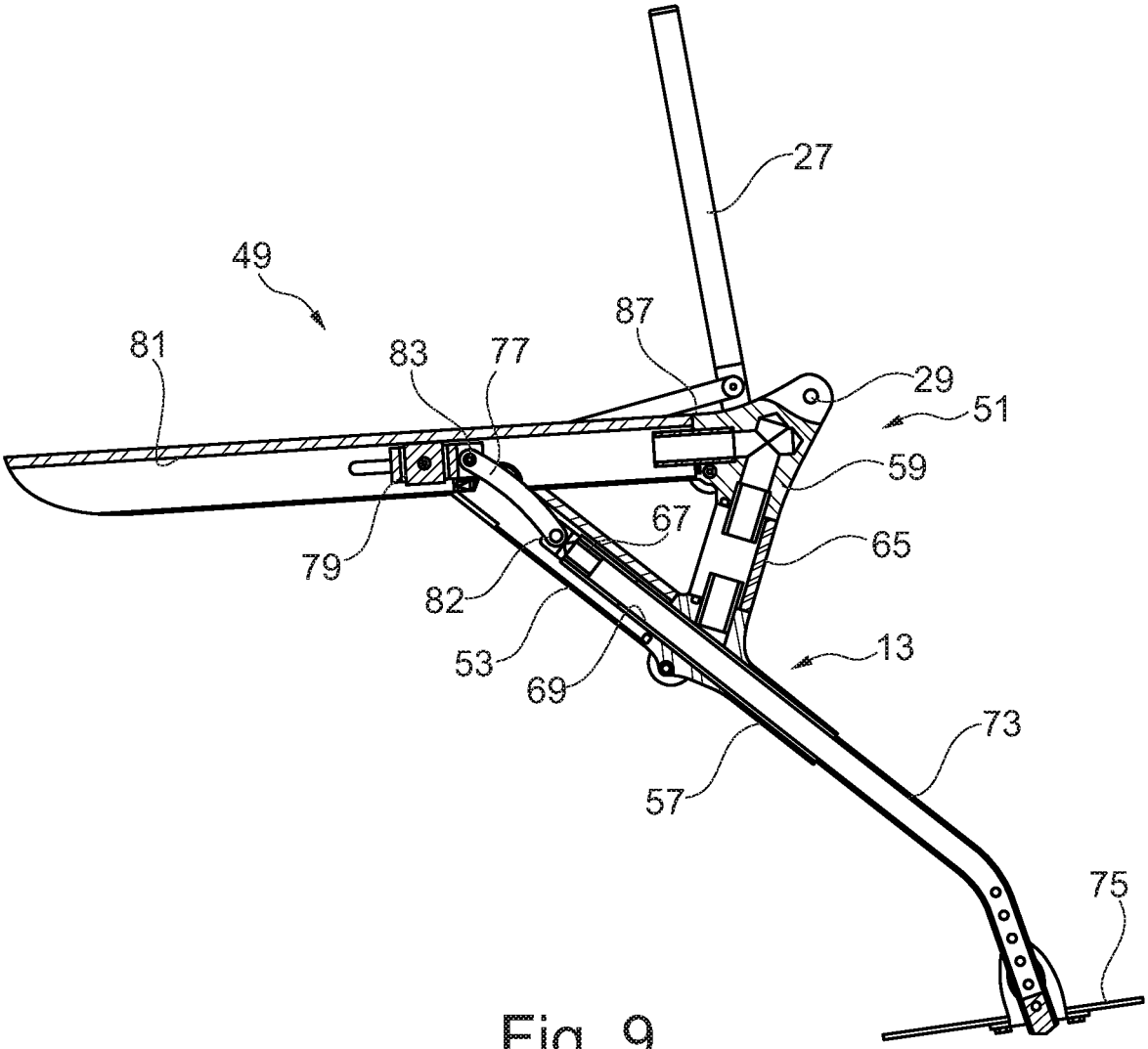
FIG. 9 is a longitudinal section through the side panel of the chassis analogous to FIG. 8 with the second parallelogram lever in the stand-up position.
Figure 10:
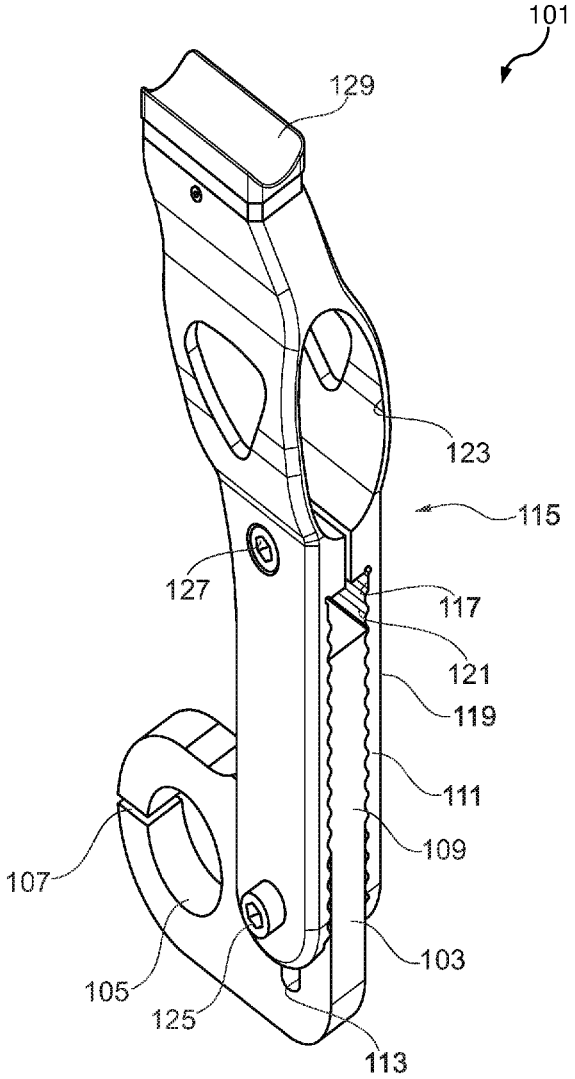
FIG. 10 is a support for the stand-up frame.

As shown particularly in FIGS. 8 and 9, the side panel 45 is composed of several individual parts. The front end 51 and the distal end 57 of the arm 53 are each made of a separate aluminium casting 59 and 61 respectively. Hollow, extruded aluminium profiles 63, 65, 67 are attached, preferably interlocking or firmly bonded, to the aluminium castings 59, 61. However, instead of aluminium, the side panels can be made of a composite material.

There is a channel 69 in arm 53 in which a leg support 71 is axially movably guided. The leg support 71 consists of a tube 73 and a footrest 75, which is arranged at the bottom ends of the tubes 73 and is adjustable in height. A lever 77 is hinged (joint point 82) at the upper end of the tube. The lever 77 is connected to a carriage 79 (joint point 83), which is axially movably guided into a channel 81 of the supporting beam 49. On the inner side of the supporting beam 49, a slot 85 (FIG. 7) is provided through which the lever 87 is hinged to the pivot point 83 by means of a connecting pin that is not shown in detail.

An advantage of the chassis 13 is that the arm 53 does not protrude over the front end 51 when the support beam 49 is horizontally arranged. This allows the leg support 71 to retract further than the initially cited stand-up wheelchair of EP-A-0815822.

A lever 87 is hinged to the carriage 79 at one end, and the adjusting rod 27 at the other. When erecting the stand-up frame 19, the leg support 71 is pushed out of the channel 69 and thus moves toward the ground, so that the leg support 71 is supported by the ground in the stand-up position. However, when the stand-up frame 19 is collapsed, the leg support 71 retracts so that it is at a distance from the ground in the sitting position. Due to the arrangement of the arm 53 in the middle third of the support beam 49, the leg support 71 can be further retracted than in the aforementioned state of the art. This has the advantage that the wheelchair user can take an active riding position, in which their lower legs form an acute angle with their thighs.

The front wheel 15 is rotatably arranged on the side panel 45. For this purpose, a connecting piece 89 is provided on the aluminium casting, on which the front wheel 15 is rotatably mounted.

The adjusting rod 27 and the sitting rod 25 are connected to each other by means of two struts 91, 93. An actuator, e.g. a linear drive, is arranged in a hinged manner between the struts 47 and 93. It has an axially movable tappet 97, by means of which the distance between the struts 47, 93 can be changed. If the tappet 97 is moved out, the stand-up frame 19 is erected, and vice versa, when the tappet 97 is retracted, the stand-up frame 19 collapses.

The rear wheels 17 are connected to each other by means of an axle 99. The supporting beams 49 are braced on this on a support 101. The support 101 consists of an assembly part 103 with a through-hole 105 for receiving the rear axle 99. The through-hole 105 has a slot 107, which can be contracted by means of a screw not visible in FIG. 10, so that the axle 99 can be clamped in the through-hole.

The assembly part 103 has an extension 109 with a corrugation 111 and an elongated hole 113. A clip 115 is fitted on the assembly part 103, which also has a corrugation 121 on the inside surfaces 117 of the legs 119. A through-hole 123 is formed above the leg 119 for receiving the support beam 49. The legs 119 can be contracted and the clip 115 fixed to the assembly part in different locking positions by means of two screws 125, 127. At the top of the clip 115, a muted part with a recess 129 is provided, in which the second parallelogram lever 27 is received in the sitting position.

A cross connection link 135 is attached to the backrest support 33. The armrests 133 are hinged to this.

In the illustrated embodiment, the backrest support 33 is in two parts consisting of the connecting piece 34 and the side pillars 32. The latter are connected to the connecting piece 34 by means of a joint 137. With the help of the joint 137, the pillars 32 can be folded down for transporting the chair. The joint 137 is designed in such a way that it preferably allows only 2 adjustment settings: a normal position in which the pillars 32 lock in at an angle of approximately 90 degrees (depending on the position of the locking element 41) with the rods 25, 27, and a transport position in which the pillars 32 are folded down and can be approximately arranged parallel to the rods 25, 27. The joint 137 is thus not intended for adjusting the tilt of the backrest, as the tilt adjustment is performed with the stand-up wheelchair according to the invention by moving the joint points.

In the suggested geometry of the stand-up wheelchair according to the invention, moving a joint point causes, in addition to an adjustment of the inclination of the backrest support 33, an adjustment of the distance of the sitting rod 25 from the adjusting rod 27, and an adjustment of their parallelism. Through appropriate adjustment of the two rods 25, 27, and in particular of their relative lengths, as well as the position of the joint points 29, 31, 35, 37, it is possible to achieve that the pillars 32 are essentially parallel to the rods 25, 27 in the stand-up position, even if the pillars 32 are tilted forwards (<90°) or backwards (>90°) in the sitting position.

Figure 11:
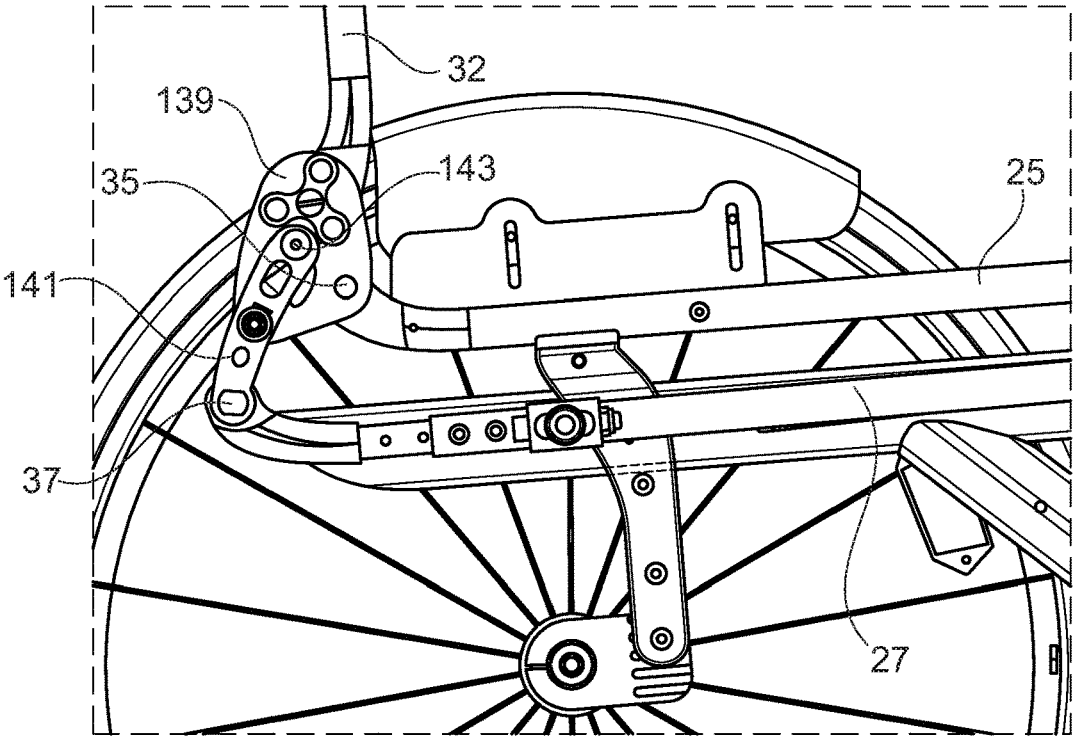
FIG. 11 is an adjusting mechanism in a second design.
Figure 12:
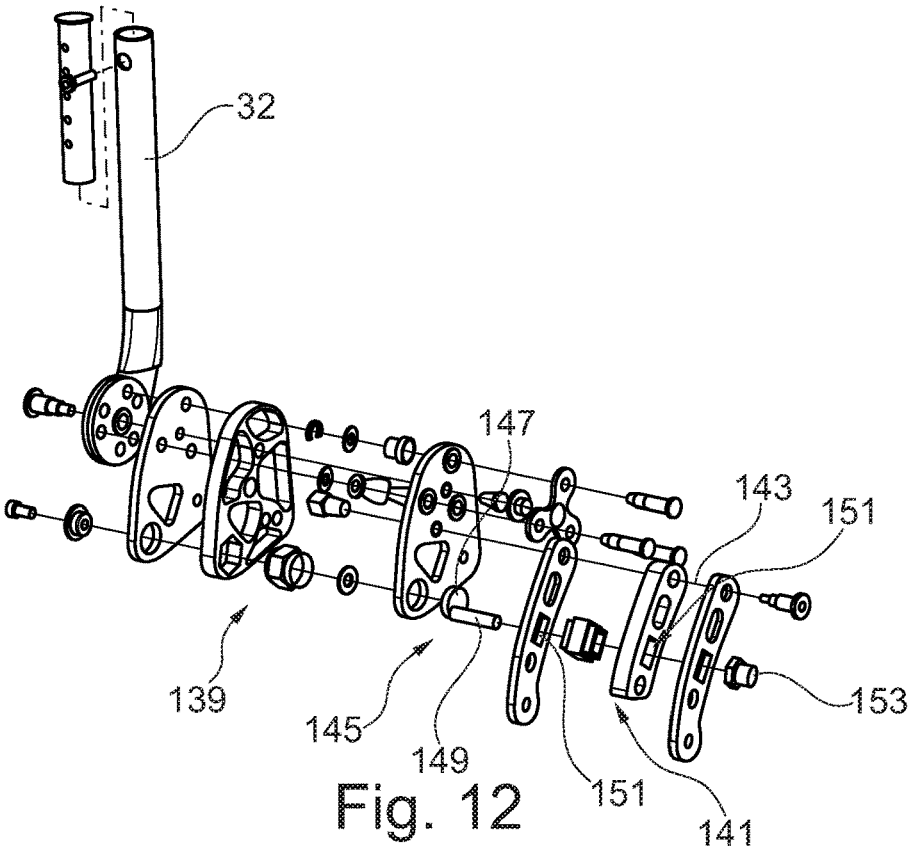
FIG. 12 is the adjusting mechanism from FIG. 11 in an exploded view.

The inclination of the backrest support 33 can also be adjusted with an adjusting mechanism according to FIG. 11 and FIG. 12. A base plate 139 and a swivel arm 141 is provided instead of the connecting piece 34. According to of FIG. 12, both are made of 3 parallel plates, but the base plate 139 and the swivel arm 141 can also be constructed as one piece. The swivel arm 141 is rotatably fixed on the base plate 139 at its first end via a fifth joint point 143. The swivel arm 141 can only be moved relative to the baseplate 139 via a cam 145. The cam 145 comprises a rotary disc 147 and a bolt 149. The bolt 149 is eccentrically fixed to the rotary disc 147. The rotary disc 147 is rotatably mounted at the base plate 139, whereas the bolt 149 is rotatably inserted through an opening 151 of the swivel arm 141. The cam 145 specifies two end positions for the swivel arm 141 relative to the base plate 139. These end positions also correspond to the maximum forward and backward inclination of the backrest support 33 and the pillars 32. Thereby, the same effect is achieved as with the elongated hole 39 and the locking element 41, but now the angle of the sitting surface 21 and backrest 23 is infinitely adjustable. Once the desired angle is set, you can brace the cam 145 with a screw 153. Angles of about +−10° can be set this way, but even larger angles are theoretically possible.

When distorting the "almost parallelogram", the adjusting rod 27 always stays in place due to the actuator 95, while the sitting rod 25 changes its angle. However, since the sitting rod 25 should always come to rest on the recess 29 of the rear axle support, the adjusting rod 27 must be slightly lowered or raised after distortion, depending on whether the back angle was increased or decreased. This is done via a levelling screw on the adjusting rod 27. This screw slightly changes the position of the location point of the actuator 95, and since the length of the actuator 95 is unchanged, the position of the adjusting rod 27 is changed and therefore also the position of the sitting rod 25. This slightly raises or lowers the sitting rod 25 so that it fits snugly into the recess 129.

The invention relates to a stand-up wheelchair with a chassis and a stand-up frame that is hinged to the chassis. The essential components of the stand-up frame are a sitting rod and an adjusting rod. Their front ends are hinged to the chassis and are pivotable around a first and a second joint point. The backrest is hinged to a third and a fourth joint point at the rear ends of the sitting rod and the adjusting rod. One of the joint points is adjustable relative to the remaining joint points and can thus effect an inclination adjustment of the backrest in the sitting position, wherein the joint points are arranged relative to each other so that, in the stand-up position, the backrest support's backrest and pillars respectively are still substantially parallel to the seat surface and the sitting rod respectively.

KEY

11 Stand-up chair
13 Chassis
15 Front wheels
17 Rear wheels
19 Stand-up frame
21 Seat
23 Backrest
25 Sitting rod (first parallelogram lever)
27 Adjusting rod (first parallelogram lever)
29 First joint point
31 Second joint point
32 Pillar
33 Backrest support
34 Connecting piece
35 Third joint point
37 Fourth joint point
39 Elongated hole
41 Locking element
45 Side panel
47 Strut
49 Supporting beam
51 Front end of the arm 53
53 Arm
55 Connecting bridge
57 Distal end of the arm 53
59 Aluminium casting (front end)
61 Aluminium casting (distal end of the arm 53)
63, 65, 67 Aluminium profile
69 Channel of the arm 53
71 Leg support
73 Tube
75 Footrest
77 Lever
79 Carriage
81 Channel of the support beam 49
83 Hole in the carriage
85 Slot
87 Lever
89 Connecting piece
91 Terminal struts between the levers 27
93 Strut
95 Actuator
97 Tappet
99 Axle
101 Support
103 Assembly part
105 Through-hole
107 Slot
109 Extension
111 Corrugation
113 Elongated hole
115 Clip

117 Inside surfaces
119 Leg
121 Corrugation of the leg 119
123 Through-hole
125, 127 Screws
129 Recess
133 Legs of the yoke
135 Base leg
137 Joint
139 Base plate
141 Swivel arm
143 Fifth joint point
145 Cam
147 Rotary disc
149 Bolt
151 Opening
153 Screw

The invention claimed is:

1. A stand-up wheelchair comprising:
(a) a chassis;
(b) a stand-up frame hinged to the chassis;
(c) a sitting rod comprising a first front end and a first back end, wherein the sitting rod is rotatably coupled to the chassis at the first front end via a first joint;
(d) an adjusting rod comprising a second front end and a second back end, wherein the adjusting rod is rotatably coupled to the chassis at the second front end via a second joint;
(e) a backrest rotatably coupled to the first and second back ends at third and fourth joints; and
(f) an adjustment mechanism rotatably coupled to the first and second back ends at the third and fourth joints, the adjustment mechanism comprising an elongated hole and a locking element slidably disposed within the elongated hole.

2. The stand-up wheelchair of claim 1, wherein the sitting rod and the adjusting rod are different lengths.

3. The stand-up wheelchair of claim 1, wherein one of the sitting rod and the adjusting rod is shorter than the other of the sitting rod and the adjusting rod by an amount ranging from about 1 to about 30 mm.

4. The stand-up wheelchair of claim 1, wherein at least one of the adjusting rod and the sitting rod is variable in length.

5. The stand-up wheelchair of claim 1, wherein the position of the fourth joint can be adjusted using the adjustment mechanism.

6. The stand-up wheelchair of claim 1, wherein the first and second joints are non-adjustable.

7. The stand-up wheelchair of claim 1, wherein the joints of the sitting rod and the adjusting rod are arranged on the chassis offset from each other by a predetermined distance in a longitudinal direction.

8. A stand-up wheelchair comprising:
(a) a chassis;
(b) a stand-up frame hinged to the chassis;
(c) a sitting rod comprising a first front end and a first back end, wherein the sitting rod is rotatably coupled to the chassis at the first front end via a first joint;
(d) an adjusting rod comprising a second front end and a second back end, wherein the adjusting rod is rotatably coupled to the chassis at the second front end via a second joint;
(e) a backrest rotatably coupled to the first and second back ends at third and fourth joints; and
(f) an adjustment mechanism rotatably coupled to the first and second back ends at the third and fourth joints, the adjustment mechanism comprising a rotatable mechanism rotatably attached to a swivel arm.

9. The stand-up wheelchair of claim 8, wherein the sitting rod and the adjusting rod are different lengths.

10. The stand-up wheelchair of claim 8, wherein one of the sitting rod and the adjusting rod is shorter than the other of the sitting rod and the adjusting rod by an amount ranging from about 1 to about 30 mm.

11. The stand-up wheelchair of claim 8, wherein at least one of the adjusting rod and the sitting rod is variable in length.

12. The stand-up wheelchair of claim 8, wherein the first and second joints are non-adjustable.

13. The stand-up wheelchair of claim 8, wherein the joints of the sitting rod and the adjusting rod are arranged on the chassis offset from each other by a predetermined distance in a longitudinal direction.

14. The stand-up wheelchair of claim 8, wherein end positions of the swivel arm relative to the adjustment mechanism are predetermined by the rotatable mechanism.

15. The stand-up wheelchair of claim 8, wherein the position of the fourth joint point can be adjusted using the adjusting mechanism.

16. The stand-up wheelchair of claim 8, wherein the joints of the sitting rod and the adjusting rod are arranged on the chassis offset from each other by a predetermined distance in a longitudinal direction.

17. A stand-up wheelchair comprising:
(a) a chassis comprising two connected side panels, wherein each of the two side panels comprises:
(i) a supporting beam; and
(ii) an arm protruding at an angle from the supporting beam at a distance from a front end of the supporting beam, the arm comprising a channel defined therein;
(b) a stand-up frame having a backrest that is pivotably articulated to the chassis; and
(c) a leg support comprising a tube on each opposing side, wherein the tube is slidably disposed within the respective channel of the arm, wherein the leg support is configured to be lowered to the ground during a transition from a sitting position to a stand-up position.

18. The stand-up wheelchair of claim 17, wherein a downwardly projecting connection piece is coupled to the arm, wherein the connection piece is configured to be coupled to front wheels.

19. The stand-up wheelchair of claim 17, wherein the arm protrudes from the supporting beam at an angle ranging from about 30 to about 60 degrees.

* * * * *